US011657932B2

(12) United States Patent
Oka

(10) Patent No.: US 11,657,932 B2
(45) Date of Patent: May 23, 2023

(54) CHIP COMPONENT

(71) Applicant: KOA CORPORATION, Ina (JP)

(72) Inventor: Naoto Oka, Ina (JP)

(73) Assignee: KOA CORPORATION, Nagano (JP)

( * ) Notice: Subject to any disclaimer, the term of this patent is extended or adjusted under 35 U.S.C. 154(b) by 0 days.

(21) Appl. No.: 17/752,200

(22) Filed: May 24, 2022

(65) Prior Publication Data

US 2022/0399140 A1 Dec. 15, 2022

(30) Foreign Application Priority Data

Jun. 10, 2021 (JP) ..... JP2021-097359

(51) Int. Cl.
*H01C 7/00* (2006.01)
*H01C 1/142* (2006.01)

(52) U.S. Cl.
CPC ..... *H01C 7/003* (2013.01); *H01C 1/142* (2013.01)

(58) Field of Classification Search
CPC ..... H01C 7/003; H01C 1/142
See application file for complete search history.

(56) References Cited

U.S. PATENT DOCUMENTS

| | | | | |
|---|---|---|---|---|
| 6,856,234 | B2 * | 2/2005 | Kuriyama | H01C 1/142 338/332 |
| 6,943,662 | B2 * | 9/2005 | Tanimura | H01C 1/142 257/537 |
| 8,193,899 | B2 * | 6/2012 | Takeuchi | H01C 17/006 338/262 |
| 9,508,473 | B2 * | 11/2016 | Yoneda | H01C 1/012 |
| 10,083,781 | B2 * | 9/2018 | Smith | H01C 17/281 |
| 10,438,729 | B2 * | 10/2019 | Wyatt | H01C 1/148 |
| 2003/0117258 | A1 * | 6/2003 | Kim | H01C 1/142 338/309 |

FOREIGN PATENT DOCUMENTS

JP 2017-45861 A 3/2017

* cited by examiner

*Primary Examiner* — Kyung S Lee
(74) *Attorney, Agent, or Firm* — Oliff PLC

(57) ABSTRACT

A chip resistor including: a rectangular parallelepiped insulating substrate; a strip-shaped resistor; a pair of front electrodes formed on a front surface of the resistor at both ends in the longitudinal direction; an insulating protective layer; and a pair of end face electrodes formed at both ends of the insulating substrate in the longitudinal direction, each of which is connected to each end face of the resistor, corresponding one of the front electrodes, and protective film; and a pair of external electrodes, wherein a cross-sectional shape of each of the front electrodes is almost a triangle in which a side of the end face has a maximum height, and a shape of an end face of each of the end face electrodes is almost a square.

6 Claims, 4 Drawing Sheets

CHIP COMPONENT

TECHNICAL FIELD

The present invention relates to a surface-mounted chip component which is typically a chip resistor.

BACKGROUND ART

A chip resistor, which is an example of a chip component, is designed to mainly include a rectangular parallelepiped insulating substrate, a pair of front electrodes oppositely disposed on the front surface of the insulating substrate with a predetermined interval therebetween, a resistor that bridges the pair of front electrodes, an insulating protective layer that covers the resistor, a pair of back electrodes oppositely disposed on the back surface of the insulating substrate with a predetermined interval therebetween, a pair of end face electrodes formed on both ends of the insulating substrate to bridge the front electrodes and the corresponding back electrodes. The outer face of each of the end face electrodes is covered with an external electrode formed by plating.

A chip resistor thus designed is surface-mounted on a circuit board by the processes of, after application of a solder paste on the lands provided on the circuit board, mounting the external electrodes on the lands with the back electrodes facing downward, and then melting and curing the solder paste in this state.

Here, each of the external electrodes to be soldered to the lands and each of the end face electrodes provided inside thereof is generally formed in a U-shape so as to be exposed at three faces (upper face, end face, and lower face) except for side faces of the chip resistor. On the other hand, as disclosed in Patent Literature 1, it has been also known that the end face electrodes are formed in a cap shape at both ends of the insulating substrate, whereby a chip resistor can be mounted on a circuit board in any posture via four faces (upper face, lower face, and both side faces) thereof.

CITATION LIST

Patent Literature

Patent Literature 1: JP-A-2017-45861

SUMMARY OF INVENTION

Technical Problem

The chip resistor according to Patent Literature 1 is formed by the processes of providing each of the front electrodes connected to both ends of the resistor so as to be exposed at three end faces on the short side and long side of the insulating substrate, respectively, and providing each of the cap-shaped end face electrodes so as to be connected to the end faces of each of the front electrodes which are exposed at the three end faces of the insulating substrate, so as to increase the connection reliability between the front electrodes and the end face electrodes. However, in recent years, downsizing of chip components which are typically chip resistors has been increasingly promoted, and for example, in the case where the outer dimension of a chip resistor is reduced to 0201 size (long side 0.250 mm, short side 0.125 mm), the contact areas between the front electrodes and the end face electrodes are significantly reduced.

This causes a problem that the connection reliability of the end face electrodes with respect to the resistor and the front electrodes decreases.

The present invention has been made in view of the circumstances described above of the prior art, and thus an object of the present invention is to provide a chip component suitable for downsizing.

Solution to Problem

In order to achieve the object described above, the present invention provides a chip component comprising: a rectangular parallelepiped insulating substrate; a strip-shaped conductive film formed on a main surface of the insulating substrate along a longitudinal direction; a pair of electrodes formed on a surface of the conductive film at both ends in the longitudinal direction; an insulating protective layer that entirely covers the main surface of the insulating substrate including the conductive film and the pair of electrodes; and a pair of cap-shaped end face electrodes formed at both ends of the insulating substrate in the longitudinal direction, and each of which is connected to an end face of the conductive film, an end face of corresponding one of the pair of electrodes, and an end face of the protective film, wherein a cross-sectional shape of each of the pair of electrodes is almost a triangle in which a side of the end face has a maximum height, and a shape of an end face of each of the pair of end face electrodes is almost a square.

In the chip component thus designed, the conductive film which is a functional element is formed in a strip shape on the insulating substrate, and the cross-sectional shape of the electrodes formed on the conductive film is almost a triangle in which the side of the end face has the maximum height. Accordingly, even in the case where the outer dimension of the chip component is reduced, it is possible to reliably connect the cap-shaped end face electrodes to the end faces of the conductive film and those of the electrodes. In addition, the protective layer is formed so as to cover the entire main surface of the insulating substrate including the conductive film and the electrodes, and the shape of the end faces of the end face electrodes covering the ends of the protective layer is almost a square. Accordingly, it is possible to realize a chip component in the shape of almost cube, which is very small and excellent in planarity.

In the chip component thus designed, the conductive film may be a conductor having a resistance value of approximately zero ohms such as a jumper chip, however, in the case of a chip resistor in which the conductive film is a resistor, it is preferable that the protective layer is formed of a glass coating layer that covers the resistor and a resin coating layer that covers the glass coating layer.

In the chip component thus designed, in the case where the film thickness of the glass coating layer is set to less than the maximum height dimension of the electrodes, the pair of electrodes is exposed at both ends of the glass coating layer. This enables a trimming groove for adjusting a resistance value in the resistor to be formed during the process of producing the chip resistor by irradiating a laser beam from above the glass coating layer while bringing a probe into contact with the pair of electrodes to measure the resistance value of the resistor.

Furthermore, in the chip component thus designed, each of the electrodes may be connected to the corresponding one of the end face electrodes at least via its end face in the longitudinal direction of the insulating substrate. On the other hand, it is preferable to connect each of the electrodes to the corresponding one of the end face electrodes via the three faces of each of the electrodes including the end face in the longitudinal direction of the insulating substrate and both the side faces adjacent to the end face so as to further enhance the connection reliability between the electrodes and the end face electrodes.

Advantageous Effects of Invention

According to the present invention, it is possible to reduce the outer dimension of a chip component while obtaining the connection reliability of end face electrodes with respect to a conductive layer and electrodes.

BRIEF DESCRIPTION OF DRAWINGS

Each

Each

DESCRIPTION OF EMBODIMENTS

Hereinafter, an embodiment of the present invention will be described with reference to the drawings.

Figure 1:
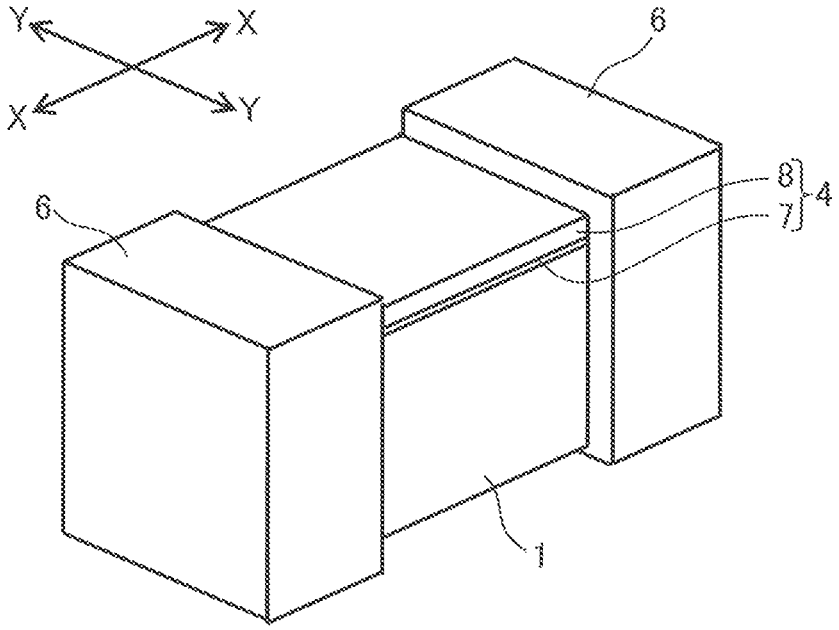
FIG. 1 is a perspective view of a chip resistor according to an embodiment of the present invention.
Figure 2:
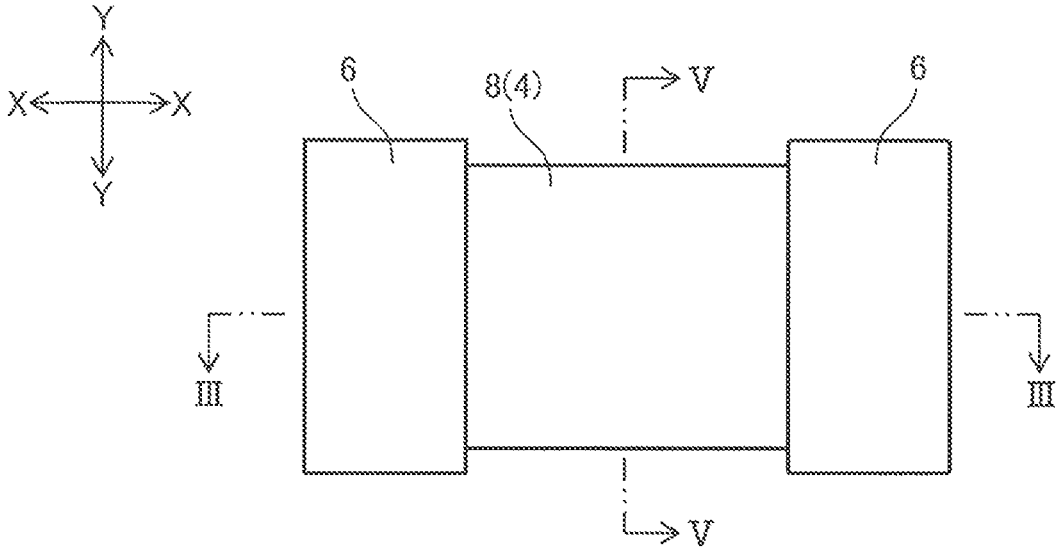
FIG. 2 is a top plan view of the chip resistor of FIG. 1.
Figure 3:
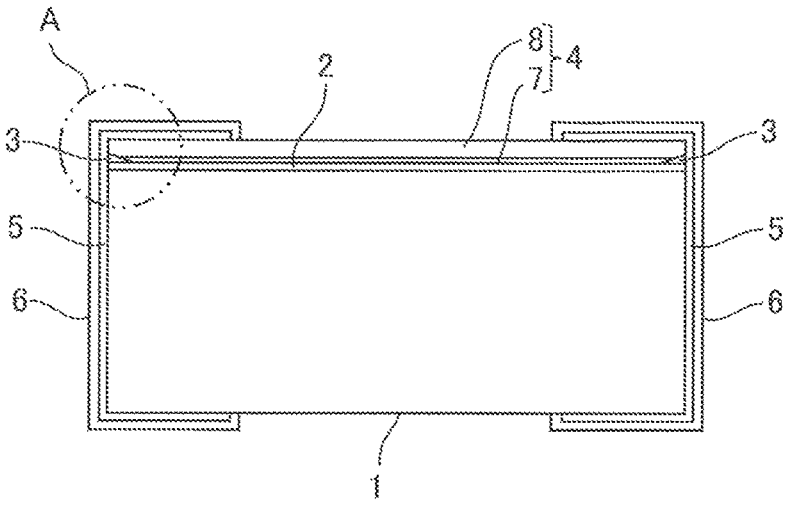
FIG. 3 is a cross-sectional view along line III-III of FIG. 2.
Figure 4:
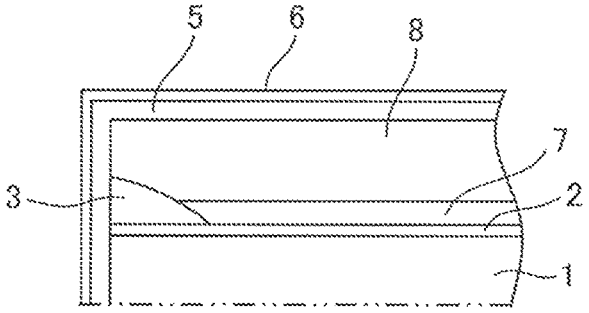
FIG. 4 is a detailed view of a portion indicated by A of FIG. 3.
Figure 5:
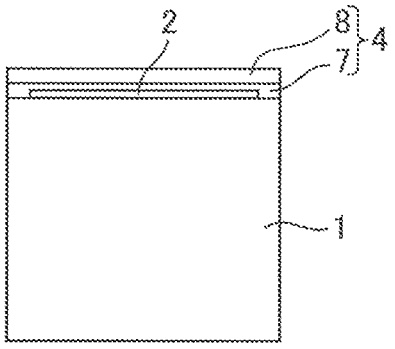
FIG. 5 is a cross-sectional view along line V-V of FIG. 2.

FIG. 1 is a perspective view of a chip resistor according to the present embodiment, FIG. 2 is a top plan view of the chip resistor of FIG. 1, FIG. 3 is a cross-sectional view along line III-III of FIG. 2, FIG. 4 is a detailed view of a portion indicated by A of FIG. 3, and FIG. 5 is a cross-sectional view along line V-V of FIG. 2.

As illustrated in FIG. 1 to FIG. 5, the chip resistor according to the present embodiment mainly includes a rectangular parallelepiped insulating substrate 1, a resistor 2 formed in a strip shape on the front surface of the insulating substrate 1 along the longitudinal direction, a pair of front electrodes 3 formed on the front surface of the resistor 2 at both ends in the longitudinal direction, an insulating protective layer 4 that covers the entire front surface of the insulating substrate 1 including the resistor 2 and the front electrodes 3, a pair of end face electrodes 5 formed at both ends in the longitudinal direction of the insulating substrate 1 so as to be connected to each end face of the resistor 2, the front electrodes 3, and the protective layer 4, and a pair of external electrodes 6 deposited on each surface of the end face electrodes 5. In the following, the longitudinal direction of the insulating substrate 1 is referred to as X-direction, and the lateral direction of the insulating substrate 1 perpendicular to the X-direction is referred to as Y-direction.

The insulating substrate 1 is a ceramic substrate mainly composed of alumina. The insulating substrate 1 is obtained with the other multiple pieces of substrates by dicing a large-sized substrate along primary division expected lines and secondary division expected lines which extend to form a grid.

The resistor 2 is formed by screen-printing a resistance paste such as ruthenium oxide on the front surface of the insulating substrate 1 and drying and sintering the paste. Both ends of the resistor 2 in the longitudinal direction are exposed at both end faces of the insulating substrate 1 in the X-direction. Although not illustrated, the resistor 2 is provided with a trimming groove for adjusting a resistance value.

The pair of front electrodes 3 are obtained by screen-printing an Ag-based paste from above the resistor 2 and drying and sintering the paste. The front electrodes 3 are formed at positions so as to overlap both the ends of the resistor 2 in the longitudinal direction, respectively. As apparent from FIG. 3 and FIG. 4, the cross-sectional shape of each of the front electrodes 3 is almost a triangle in which the side of the end face of the insulating substrate 1 in the X-direction has the maximum height. The front electrodes 3 are exposed not only at the end faces of the insulating substrate 1 in the X-direction, but also exposed at both end faces of the insulating substrate 1 in the Y-direction.

The protective layer 4 has a double-layer structure of a glass coating layer 7 that covers the resistor 2 and a resin coating layer 8 that covers the glass coating layer 7. The glass coating layer 7 is formed by screen-printing a glass paste from above the resistor 2 and drying and sintering the paste so as to cover the resistor 2, and is exposed at both the end faces of the insulating substrate 1 in the Y-direction. The film thickness of the glass coating layer 7 is set to less than the maximum height dimension of the front electrodes 3. Accordingly, the glass coating layer 7 is not exposed at both the end faces of the insulating substrate 1 in the X-direction, and at both end faces of the glass coating layer 7 in the X-direction, inclined faces of the front electrodes 3 are exposed, respectively.

The resin coating layer 8 is formed by screen-printing an epoxy-based resin paste from above the glass coating layer 7 and heating and curing the paste. The resin coating layer 8 is formed of a transparent or translucent resin material or the like. Since the resin coating layer 8 is formed so as to cover the entire front surface of the insulating substrate 1 including the front electrodes 3 and the glass coating layer 7, as illustrated in FIG. 1, both end faces of the resin coating layer 8 in the Y-direction are exposed, together with the glass coating layer 7, at both side faces of the insulating substrate 1.

The pair of end face electrodes 5 is formed by dip-coating an Ag paste or Cu paste and heating and curing the paste. Each of the end face electrodes 5 is formed in a cap shape so as to cover the upper face of the resin coating layer 8 and the lower face and both side faces of the insulating substrate 1 from both the end faces in the X-direction of the insulating substrate 1. Thus, the end face electrodes 5 are connected to the end faces of the resistor 2 in the X-direction, respectively, and are connected to the front electrodes 3 exposed at the three end faces of the insulating substrate 1, respectively. Note that the outer shape of a chip element body before the end face electrodes 5 are formed is almost a cube, and at both the end faces in the longitudinal direction of the chip element body having such a shape, the end face electrodes 5 in the shape of a cap are formed, respectively. That is, the insulating substrate 1 has a rectangular parallelepiped shape in which the thickness dimension (length in the height direction in FIG. 1) is less than the width dimension (length in the Y-direction), however, the protective layer 4 (glass coating layer 7 and resin coating layer 8) having a predetermined thickness is laminated thereon so as to cover the entire front surface of the insulating substrate 1, whereby the chip element body in the shape of cube in which the width dimension is equal to the thickness dimension can be obtained.

Although not illustrated, the pair of end face electrodes 5 is covered by the external electrodes, respectively. The external electrodes are formed by electroplating Ni, Sn or the like on the surfaces of the end face electrodes 5, respectively.

Next, a method of producing the chip resistor designed as described above will be explained with reference to FIG. 6 and FIG. 7. Each FIG. 6A-6F is a plan view illustrating producing processes of the chip resistor, and each FIG. 7A-7F is a cross-sectional view illustrating the producing processes of the chip resistor.

The first process is to prepare a large-sized substrate 10A made of ceramic from which multiple pieces of insulating substrates 1 are to be obtained. The large-sized substrate 10A is not provided with any primary division groove and secondary division groove, on the other hand, as dicing positions during dividing the large-sized substrate 10A into multiple pieces of chip elements in subsequent processes, primary division expected lines L1 and secondary division expected lines L2 are set on the large-sized substrate 10A. That is, where the lateral direction of the large-sized substrate 10A is defined as the X-direction and the vertical direction is defined as the Y-direction in FIG. 6, the primary division expected lines L1 extending in the Y-direction and the secondary division expected lines L2 extending in the X-direction are set so as to form a grid on the large-sized substrate 10A. Each one of the squares delimited by both the division expected lines L1, L2 serves as one chip forming region.

Figure 6A:
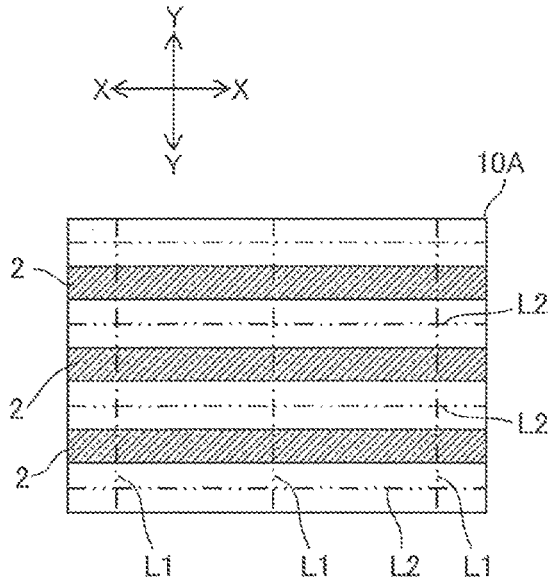
FIG. 6A-6F is a plan view illustrating production processes of the chip resistor.
Figure 6D:
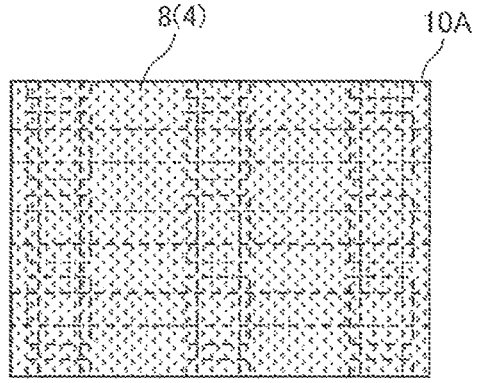
Figure 6B:
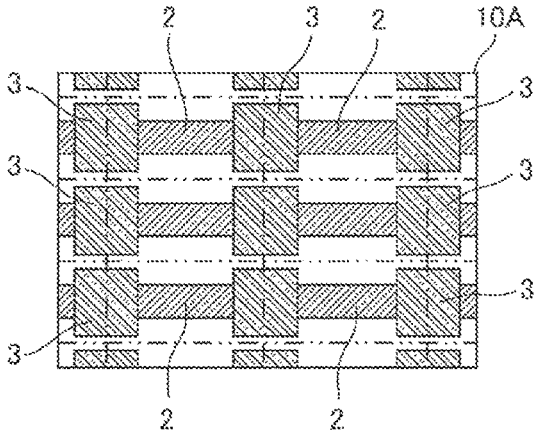
Figure 6E:
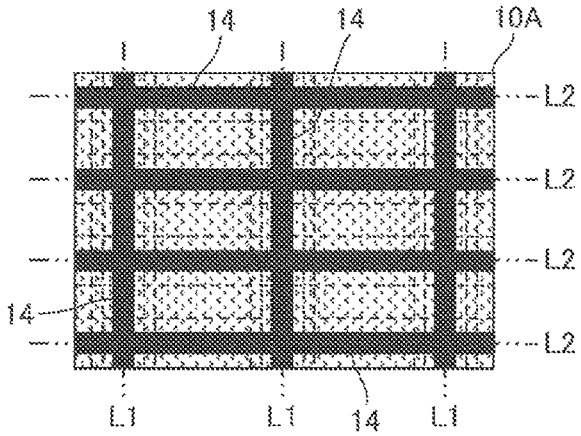
Figure 6C:
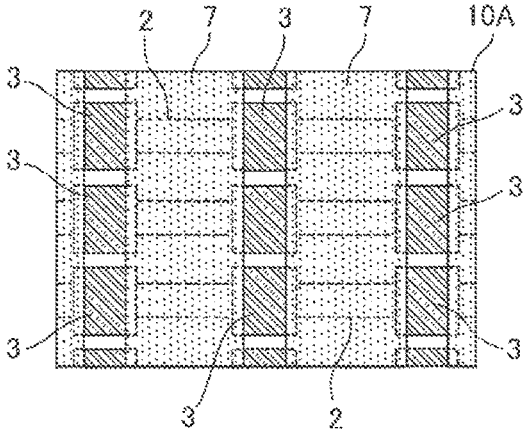
Figure 6F:
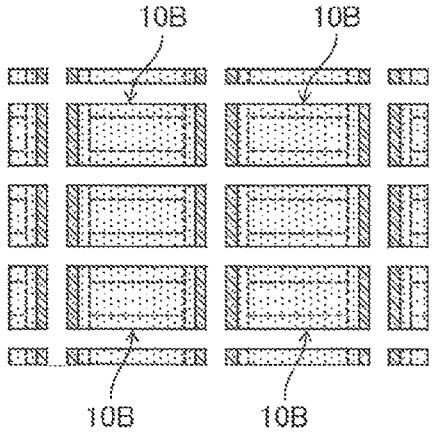
Figure 7A:
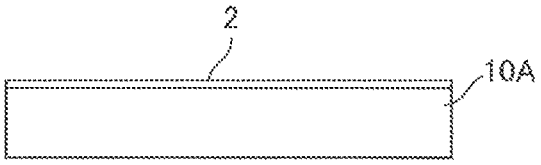
FIG. 7A-7F is a cross-sectional view illustrating production processes of the chip resistor.

Then, by screen-printing a resistance paste such as ruthenium oxide on the front surface of the large-sized substrate 10A designed as described above and drying and sintering the paste, as illustrated in FIG. 6A and FIG. 7A, the process of forming a plurality of resistors 2 each of which extends in a strip shape in the X-direction across the primary division expected lines L1 within an area interposed between the secondary division expected lines L2 is performed (resistor forming process). Note that FIG. 6 illustrates the large-sized substrate 10A viewed from the top, and FIG. 7 illustrates a cross section of one of the chip forming regions taken along the longitudinal direction of the resistor 2 in FIG. 6.

Figure 7D:
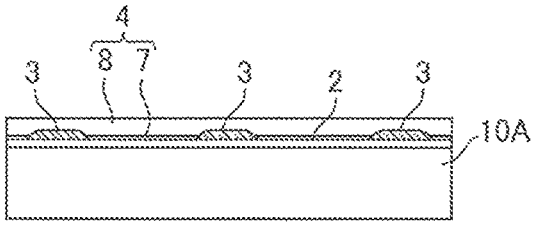
Figure 7B:
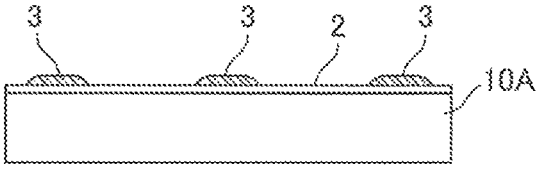

Next, by printing an Ag-based paste on the front surface of the large-sized substrate 10A and drying and sintering the paste, as illustrated in FIG. 6B and FIG. 7B, the process of forming the plurality of front electrodes 3 opposed to each other with a predetermined interval therebetween in the X-direction on the positions on which the primary division expected lines L1 overlap the resistors 2, respectively, is performed (front electrode forming process). Each of the front electrodes 3 is printed in a rectangular shape having a relatively thick film (4 μm or more), and the film thickness thereof gradually decreases toward both end portions in the X-direction from the central portion due to the viscosity of the paste.

Figure 7E:
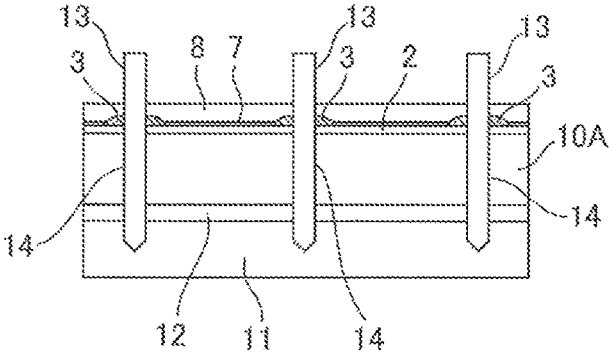
Figure 7C:
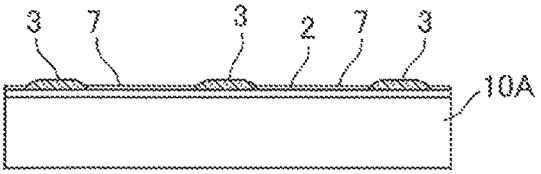

Next, by screen-printing a glass paste and drying and sintering the paste, as illustrated in FIG. 6C and FIG. 7C, the process of forming the transparent glass coating layer 7 that covers the resistor 2 exposed between the pair of front electrodes 3 is performed (glass coating layer forming process). This glass coating layer 7 is formed in a strip shape which extends in the Y-direction that intersects the longitudinal direction of the resistor 2 across the secondary division expected lines L2.

Next, by irradiating a laser beam from above the glass coating layer 7 while bringing a probe for measurement (not illustrated) into contact with the pair of front electrodes 3 exposed at both the ends of the glass coating layer 7 to measure a resistance value of the resistor 2 between the pair of front electrodes 3 in this state, the process of forming a trimming groove (not illustrated) for adjusting the resistance value on the resistor 2 is performed (resistance value adjusting process).

Next, by print-screening an epoxy-based resin paste, to which a white pigment is added, from above the front electrodes 3 and the glass coating layer 7 and heating and curing the paste, as illustrated in FIG. 6D and FIG. 7D, the process of forming a translucent resin coating layer 8 covering the entire chip forming region of the large-sized substrate 10A including the front electrodes 3 and the glass coating layer 7 is performed (resin coating layer forming process). The glass coating layer 7 and the resin coating layer 8 are formed as described above, whereby the protective layer 4 having a double-layer structure can be obtained. Since the protective layer 4 is a laminated body of the transparent glass coating layer 7 and the translucent resin coating layer 8, the positions of the front electrodes 3 and resistor 2 provided inside can be viewed through the protective layer 4.

Next, after fixing the large-sized substrate 10A, through an adhesive 12, to a base member 11 for fixing made of a hard material such as ceramic, by cutting the large-sized substrate 10A with dicing blades 13 along the primary division expected lines L1 and the secondary division expected lines L2, as illustrated in FIG. 6E and FIG. 7E, the process of forming through-slits 14, which have a grid shape in a plan view and penetrate the large-sized substrate 10A until it reaches the middle of the base member 11 for fixing, is performed (dicing process). At this time, since the front electrodes 3 formed to extend across the primary division expected lines L1 are divided by dicing along the primary division expected lines L1, the cross-sectional shape of each of the front electrodes 3, which have been printed and formed to be short, is almost a triangle in which the height of the cut surface along the primary division expected line L1 is the maximum height. Furthermore, since both end portions of each of the front electrodes 3 extending from the resistor 2 in the Y-direction are cut by dicing along the secondary division expected lines L2, each of the cut surfaces of the front electrodes 3 is exposed at three faces of each of the through slits 14.

In this dicing process, since the positions of the front electrodes 3 and resistor 2 provided inside can be viewed through the protective layer 4 covering the entire front surface of the large-sized substrate 10A, it is possible to accurately determine the dicing positions (primary division expected lines L1 and secondary division expected lines L2). Note that the primary division expected lines L1 and the secondary division expected lines L2 are virtual lines to be set with respect to the large-sized substrate 10A, and thus as mentioned above, any primary division groove and secondary division groove corresponding to the division expected lines are not provided on the large-sized substrate 10A.

Figure 7F:
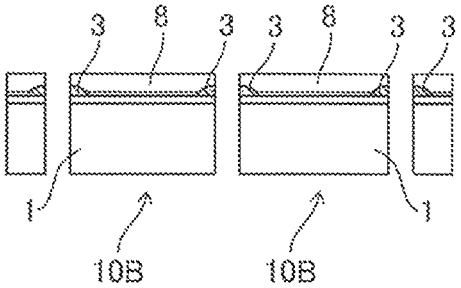

Next, by washing the adhesive 12 and peeling off the base member 11 for fixing from the large-sized substrate 10A, as illustrated in FIG. 6F and FIG. 7F, the process of obtaining multiple pieces of chip element bodies 10B each of which has substantially the same external shape as that of a chip resistor is performed.

Although the subsequent steps are not illustrated, by dip-coating a conductive paste such as an Ag paste or Cu paste on end faces of each of the chip element body 10B and heating and curing the paste, the process of forming the cap-shaped end face electrodes which wrap from both end faces in the longitudinal direction to predetermined positions on both end faces in the lateral direction of the chip element body 10B is performed (end face electrode forming process).

At this time, since the external shape of the chip element body 10B is almost a cube, each of the end face electrodes wrapping around the four faces of the chip element body 10B has a rectangular shape in which the face in contact with the surface of the protective layer 4 and the remaining three faces in contact with the three ceramic surfaces have the same size.

Finally, by providing each of the chip element bodies 10B with an electroplating layer such as Ni, Sn, and the like, the process of forming the external electrodes that cover the end face electrodes, respectively, is performed (external electrode forming process). Through these processes, a chip resistor as illustrated in FIG. 1 to FIG. 5 can be obtained.

As described above, in the chip resistor according to the present embodiment, the resistor 2 which is a functional element is formed in a strip shape on the insulating substrate 1, and the cross-sectional shape of each of the front electrodes 3 formed on both the end of the resistor 2 is almost a triangle in which the side of the end face has the maximum height. Accordingly, even in the case where the outer dimension of the chip resistor is reduced, it is possible to reliably connect the cap-shaped end face electrodes 5 to the end faces of the resistor 2 and those of the front electrodes 3. In addition, the protective layer 4 is formed so as to cover the entire front surface of the insulating substrate 1 including the resistor 2 and the front electrodes 3, and the shape of the end faces of the end face electrodes 5 covering the ends of the protective layer 4 is almost a square. Accordingly, it is possible to realize a chip component in the shape of almost cube, which is very small and excellent in planarity.

In the chip resistor according to the present embodiment, within the protective layer 4 having a double-layer structure formed of the glass coating layer 7 and the resin coating layer 8, the film thickness of the glass coating layer 7 is set to less than the maximum height dimension of the front electrodes 3, whereby the pair of front electrodes 3 is exposed at both ends of the glass coating layer 7. Accordingly, in the resistance value adjusting process of adjusting the resistance value of the resistor 2, it is possible to form a trimming groove in the resistor 2 by irradiating a laser beam from above the glass coating layer 7 while bringing a probe into contact with the pair of front electrodes 3 to measure the resistance value of the resistor 2.

Furthermore, in the chip resistor according to the present embodiment, each of the front electrodes 3 is exposed not only at the end face of the insulating substrate 1 in the longitudinal direction, but also exposed at both the side faces of the insulating substrate 1 in the lateral direction. Thus, each of the end face electrodes 5 is connected to the corresponding one of the front electrodes 3 via these three faces, and accordingly, it is possible to increase the connection reliability between the front electrodes 3 and the end face electrodes 5.

In the embodiment above, the case where the present invention is applied to a chip resistor whose conductive film as a functional element is a resistor has been described. However, the conductive film may be the one other than a resistor, for example, a conductor having a resistance value of approximately zero ohms such as a jumper chip. In such a case, since the resistance value adjustment of the conductive film is not necessary, the protective layer may have a single-layer structure of only the resin coating layer.

REFERENCE SIGNS LIST

1 insulating substrate
2 resistor
3 front electrode
4 protective layer
5 end face electrode
6 external electrode
7 glass coating layer
8 resin coating layer
10A large-sized substrate
10B chip element body
11 base member for fixing
12 adhesive
13 dicing blade
14 through-slit

The invention claimed is:

1. A chip component comprising:

a rectangular parallelepiped insulating substrate;

a strip-shaped conductive film formed on a main surface of the insulating substrate along a longitudinal direction;

a pair of electrodes formed on a surface of the conductive film at both ends in the longitudinal direction;

an insulating protective layer that entirely covers the main surface of the insulating substrate including the conductive film and the pair of electrodes; and a pair of cap-shaped end face electrodes formed at both ends of the insulating substrate in the longitudinal direction, and each of which is connected to an end face of the conductive film, an end face of corresponding one of the pair of electrodes, and an end face of the protective film, wherein a cross-sectional shape of each of the pair of electrodes is almost a triangle in which a side of the end face has a maximum height, and a shape of an end face of each of the pair of end face electrodes is almost a square.

2. The chip component according to claim 1, wherein the conductive film is a resistor, and the protective layer is formed of a glass coating layer that covers the resistor and a resin coating layer that covers the glass coating layer.

3. The chip component according to claim 1, wherein a film thickness of the glass coating layer is less than a maximum height dimension of the pair of electrodes.

4. The chip component according to claim 1, wherein the pair of electrodes is connected to corresponding one of the pair of end face electrodes via three faces of each of the pair of electrodes including an end face in the longitudinal direction of the insulating substrate and both side faces adjacent to the end face.

5. The chip component according to claim 2, wherein the pair of electrodes is connected to corresponding one of the pair of end face electrodes via three faces of each of the pair of electrodes including an end face in the longitudinal direction of the insulating substrate and both side faces adjacent to the end face.

6. The chip component according to claim 3, wherein the pair of electrodes is connected to corresponding one of the pair of end face electrodes via three faces of each of the pair of electrodes including an end face in the longitudinal direction of the insulating substrate and both side faces adjacent to the end face.

* * * * *